US007530207B2

(12) United States Patent
Morrill

(10) Patent No.: US 7,530,207 B2
(45) Date of Patent: May 12, 2009

(54) INSULATION CANE

(76) Inventor: Alan Morrill, 810 Grove St., Scott City, MO (US) 63780

( * ) Notice: Subject to any disclaimer, the term of this patent is extended or adjusted under 35 U.S.C. 154(b) by 522 days.

(21) Appl. No.: 11/049,546

(22) Filed: Feb. 1, 2005

(65) Prior Publication Data

US 2005/0183368 A1 Aug. 25, 2005

Related U.S. Application Data

(60) Provisional application No. 60/542,142, filed on Feb. 6, 2004.

(51) Int. Cl.
*E04B 1/00* (2006.01)
*E04G 21/00* (2006.01)
*E04G 23/00* (2006.01)

(52) U.S. Cl. ..... 52/746.11; 52/749.12; 52/DIG. 1

(58) Field of Classification Search ..... 52/746.11, 52/749.12, DIG. 1
See application file for complete search history.

(56) References Cited

U.S. PATENT DOCUMENTS 2,095,412 A * 10/1937 Edwards ..... 132/244
2,472,500 A * 6/1949 Swanson ..... 294/92
2,999,278 A 9/1961 Spencer et al.
3,355,203 A 11/1967 Stauffer
3,678,561 A * 7/1972 Mautz, Sr. ..... 29/267
4,069,636 A 1/1978 Kessler
4,251,972 A 2/1981 Interlante
4,318,260 A 3/1982 Siegel et al.
4,715,156 A 12/1987 Dozzo
5,695,230 A * 12/1997 Thompson ..... 294/15

* cited by examiner

*Primary Examiner*—Richard E Chilcot, Jr.
*Assistant Examiner*—Chi Q Nguyen
(74) *Attorney, Agent, or Firm*—Paul M Denk

(57) ABSTRACT

Pre-engineered buildings require insulation for heating and cooling due to thin metal paneling. Buildings lose heat highly through the roof. To lessen building heat loss, contractors install insulation between purlins. During construction, contractors may need temporary support for insulation. The insulation retaining member provides temporary support with a tube and a hook assembled into a walking cane like shape. The hook has a general J shape with a shank and an opposite barb. The shank inserts into the tube and is crimped. In use, a contractor places the hook over the flange of a purlin then swings the tube to rest upon the flange of an adjacent purlin. The insulation then rests upon the tube when applied.

1 Claim, 3 Drawing Sheets

INSULATION CANE

CROSS REFERENCE TO RELATED APPLICATION

This non-provisional patent application claims priority to the provisional patent application having Ser. No. 60/542,142, which was filed on Feb. 6, 2004.

BACKGROUND OF THE INVENTION

The insulation retaining member relates to secondary parts of pre-engineered buildings in general and more specifically to supports spanning between roof rafters. A unique aspect of the insulation retaining member is ready removal from a purlin.

In a typical pre-engineered building, frames attach to a foundation, secondary members attach to the frames, and paneling attaches to the secondary members. To form a roof, panels attach to purlins that join the frames. The purlins span from frame to frame and commonly have a Z shape or C shape cross-section. A purlin has a flange as the lower horizontal member with an upturned lip. As constructed, a pre-engineered building has limited heat or cooling retention, suitable for some uses. For other uses and habitation, insulation installed in the building retains heat in winter and cooling in summer.

During construction of a pre-engineered building, a contractor prefers to install the insulation as the roof paneling progresses. The contractor coordinates equipment and labor to minimize time on the roof. This method works well in dry weather but exposes the insulation to moisture in other conditions. Damp insulation loses its capability. As an alternate method, the contractor installs the roof panel before the insulation. Approaching the roof from beneath, the contractor positions the insulation between purlins. The contractor holds the insulation in place with supports installed purlin to purlin, and perpendicular to the length of the purlins. To complete installation of the insulation, the contractor runs banding across the lower flanges of the purlins from the eave to the peak of the building at a regular interval.

Prior art designs supported insulation with shaped wire, fitted hooks on supports, extensible members, and linked straps. Though supporting insulation, the prior art permanently installed within the purlins and required shaped hooks to match the flange of a purlin. The prior art remained fixed in the roof, interfered with utility lines, and tended to have higher installation costs.

The present art overcomes the limitations of the prior art. That is, the art of the present invention, insulation retaining member, installs readily, retains insulation within a roof prior to banding, and removes readily if needed.

The difficulty in providing an insulation retaining member is shown by the is operation of a typical support. A laborer places and holds insulation near the roof between two purlins. The laborer grasps a support and places the free end of the support upon the lip of the lower flange of a rafter. The free end merely rests upon the lip beneath the insulation. Opposite the free end, the support has a hook end. The laborer grasps the hook end and presses it upon the lower flange of an adjacent rafter. The hook snaps into place and snugly grasps the lip of the lower flange. Removal of the support requires deforming the hook to release it from the lip. The present invention overcomes the removal difficulty.

The use of members to support insulation in a roof is known in the prior art. For example, U.S. Pat. No. 2,999,278 to Spencer et al., discloses an insulation mounting formed from a center run and two opposing telescoping extensions. One extension rests upon a rafter's flange and the other extension clips to a second rafter's flange. The mounting has a V shaped cross section and rests upon the top flanges of rafters proximate to the roof paneling.

The patent to Stauffer, U.S. Pat. No. 3,355,203, shows an insulation retainer of bent and configured wire. Having a generally X shape, the retainer spans between two joists or studs to support insulation. An installer partially bends the arms of the X shape towards the center, places the retainer between two joists, and allows the retainer to dig into the joist by spring action.

The patent to Kessler, U.S. Pat. No. 4,069,636, shows a single piece insulation supporting strap. The straps hook onto the flanges of I beams, C channels, or Z rafters to hold insulation batts in place. One end of the strap hooks over a flange and the opposite end snaps onto the lip of a flange. Two or more straps interconnect with a male/female joining of opposite ends of the straps.

The patent to Interlante, U.S. Pat. No. 4,251,972, shows ceiling panel supports with two opposing ends. One end rests upon the lip of a rafter while the opposite end hooks to the lip of a second rafter. The support has an inverted U shape cross section and springing action to set the hook upon a second rafter. The support holds ceiling panels and insulation in place and minimizes deflection.

The patent to Siegel et al., U.S. Pat. No. 4,318,260, shows a strap system to support building insulation between rafters. The strap has a generally linear shape with raised longitudinal lips. Each end of the strap has a keyhole with a circular opening then a radial opening of smaller width than the circular opening. A button inserted through the keyholes of two strap ends joins straps into a continuous string. One end of each strap has a tab that folds upon a rafter lip to attach a string of supports to the roof beneath the insulation.

The patent to Dozzo, U.S. Pat. No. 4,715,156, shows a brace and stringer system forming a grid to support building insulation between rafters. The braces span rafter to rafter and the stringers span brace to brace near the center. The braces and stringers have a linear shape with a V shaped cross section. At both ends, a brace has a flat cross section for bending around the lips of I beam flanges or resting upon the lips of flanges of C shape or Z shape rafters. The stringers have ends of flat cross section for securing adjacent stringers into a continuous line across braces.

Thus, prior art devices do not provide for an insulation retaining member that both installs and removes readily upon the flanges of two adjacent purlins. The insulation retaining member has the shape of a cane and installs the hook upon the flange of a rafter and rests the opposite end of the cane upon the flange of an adjacent rafter. Insulation then rests upon the cane shaped member until the member is removed.

SUMMARY OF THE INVENTION

An insulation retaining member begins with a tube and a hook assembled into a walking cane shape. The hook has a general J shape with a shank and an opposite barb. The shank inserts into the tube. A crimp upon the tube secures the hook forming the cane shape. Preferably the tube is hollow and the hook is solid in cross section. The insulation retaining member provides a temporary support for roof insulation during work by a contractor. A contractor places the hook over the flange of a rafter then swings the tube to rest upon the flange of an adjacent rafter. The contractor repeats these steps as needed. After placing permanent banding across the insulation and rafters, the contractor swings the tube away from the flange, releases the hook, and removes the insulation retaining member for reuse.

DESCRIPTION OF THE PREFERRED EMBODIMENT

Figure 1:
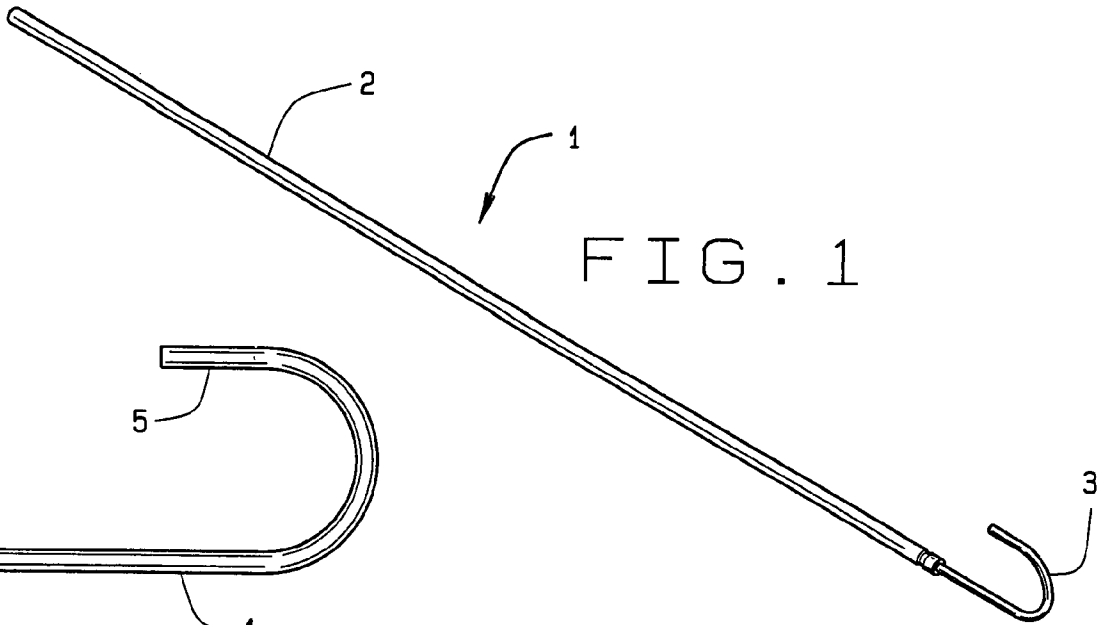
FIG. 1 shows an oblique view of the preferred embodiment of the insulation retaining member constructed in accordance with the principles of the present invention.

The present art overcomes the prior art limitations by two piece assembly and a hook that loosely grasps a flange. Turning to FIG. 1, the preferred embodiment of the insulation retaining member 1 is shown. The insulation retaining member 1 has the appearance of a walking cane 1 formed from two parts: a tube 2 and a hook 3. The tube 2 has a generally cylindrical shape of sufficient length to span between two purlins 6. The hook 3 has a generally J shape and joins the tube 2 at one end. In the preferred embodiment, the tube 2 is hollow and the hook 3 is of solid cross section.

Figure 2:
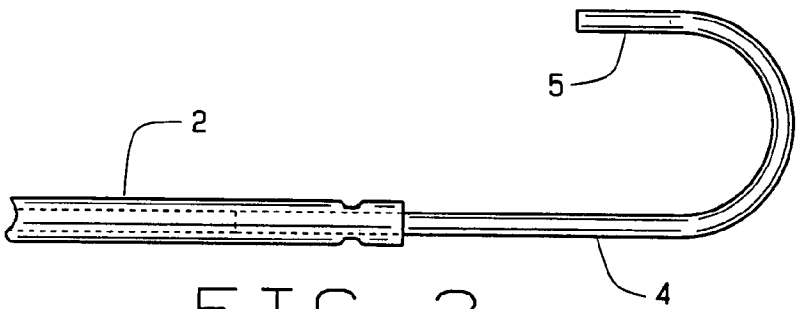
FIG. 2 shows a detailed view of a portion of the insulation retaining member.

Viewing FIG. 2, the hook 3 has a shank 4, and a barb 5 shorter than the shank 4. The shank 4 inserts partially along the length of the shank 4 into one end of the tube 2. The hook 3 secures to the tube 2 by a crimp imposed upon the end of the tube 2. The crimp compresses the tube 2 to secure the shank 4 of the hook 3 within the tube 2 by friction. In the preferred embodiment, one half-inch conduit serves as the tube 2 and #3 rebar serves as the hook 3.

Figure 3:
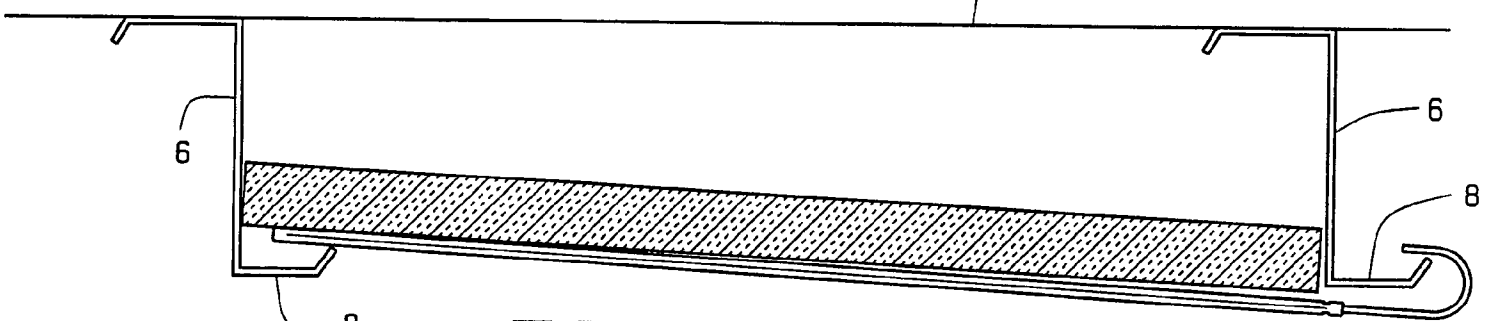
FIG. 3 shows an elevation view of the insulation retaining member installed in a roof.

To utilize the present art, an installer places a portion of insulation between two purlins 6 as shown in FIG. 3. The installer then grasps an insulation retaining member 1 shaped like a cane 1 and positions it near the roof 7. Holding the insulation, the installer places the hook 3 with the barb 5 contacting the lip of the lower flange 8 of a purlin 6. The installer then extends the telescopic tube 2 to rest the end opposite the hook 3 upon the lip of the lower flange 8 of an adjacent purlin 6. Insulation then rests upon the cane 1 that rests upon the lower flanges 8 of two adjacent purlins 6.

Figure 4:
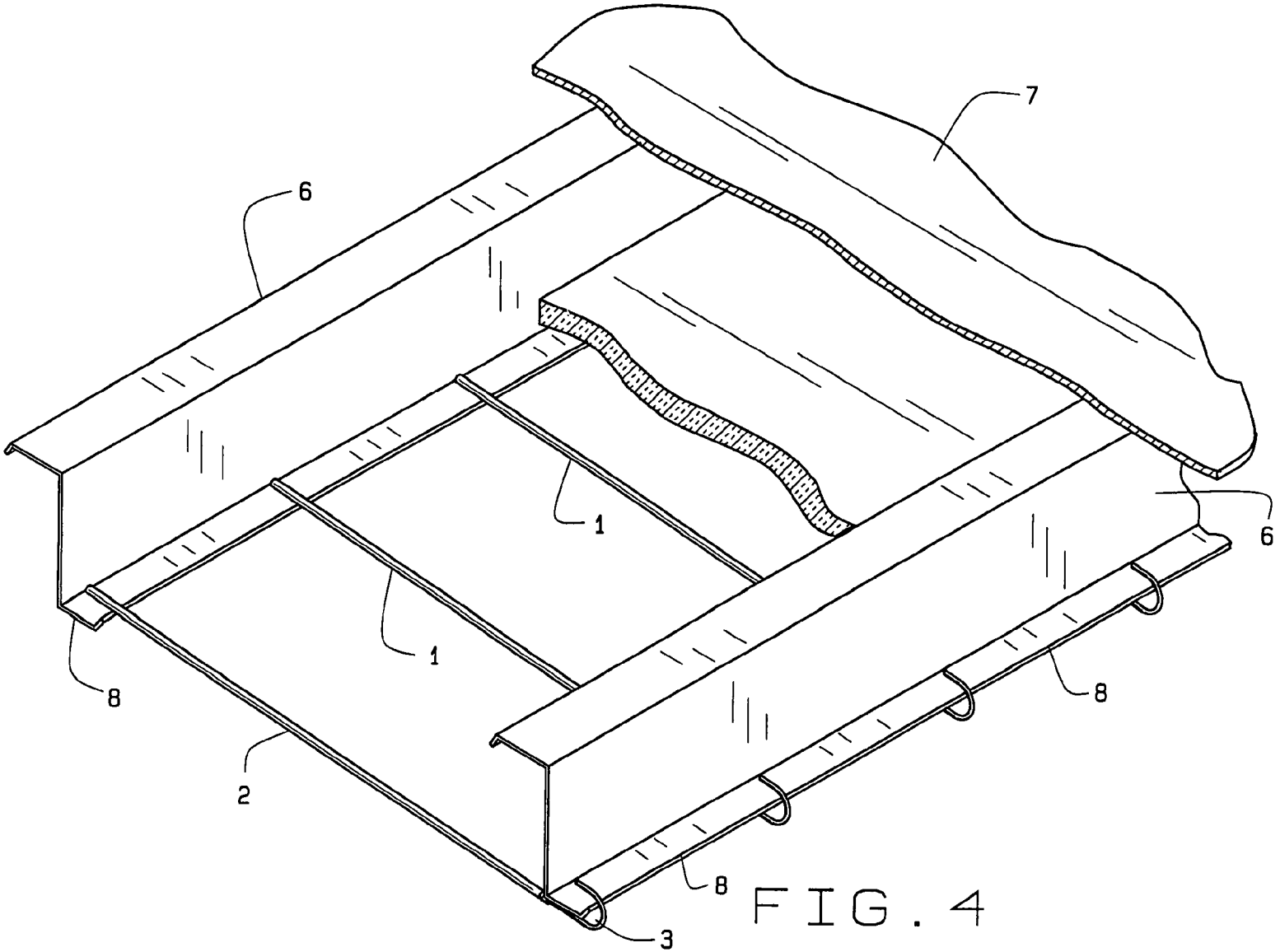
FIG. 4 shows an oblique view of a gang of the insulation retaining members in a roof.

Expanding from a single cane 1 installation, FIG. 4 shows a gang of insulation retaining members 1 installed in a roof 7. The canes 1, installed as described for FIG. 3, have a regular spacing along the purlins 6. Insulation rests upon the canes 1 and insulates a building. Above the insulation, the roof 7 protects a building from the elements.

Figure 5:
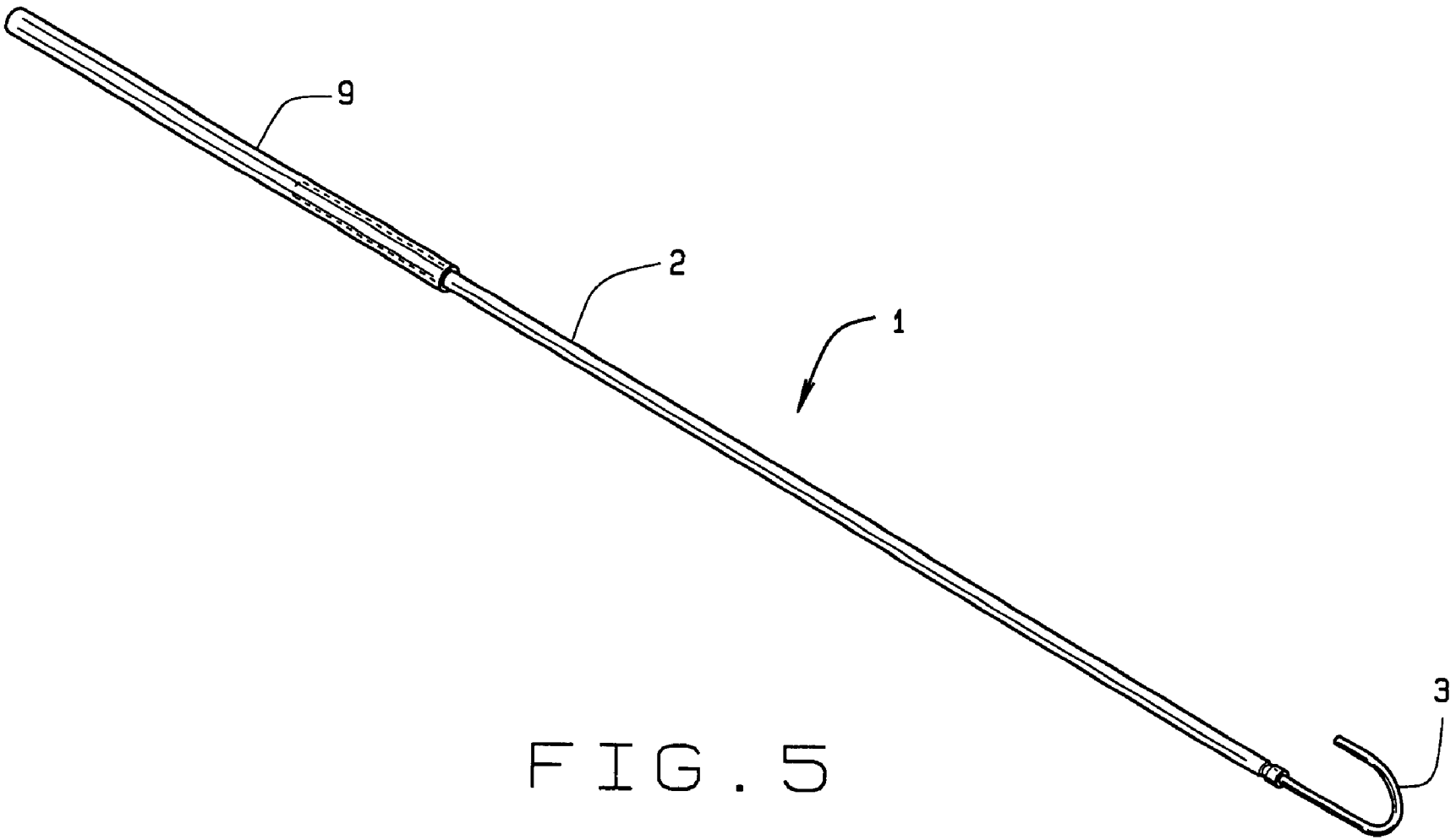
FIG. 5 shows the insulation retaining member with telescopic extension provided for varying the length of the member during usage.

FIG. 5 shows a view of the insulation retaining member, or insulation cane, to which is attached an extension sleeve 9, that is telescopically mounted upon the tube 2, and which can be slid axially longitudinally thereof, in order to vary the length of the member, during usage, depending upon the spacing apart of the purlins 6.

From the aforementioned description, an insulation retaining member has been described. The insulation retaining member is uniquely capable of rapid though temporary installation and support of insulation between two adjacent purlins. The insulation retaining member and its various components may be manufactured from many materials including but not limited to polymers, nylon, ferrous and non-ferrous metals, their alloys, and composites.

I claim:

1. A method of supporting insulation between purlins in a building, the steps comprising:

placing a hook upon a lower flange of a purlin;

holding insulation above the lower flange of said purlin;

rotating a tube joined to said hook towards an adjacent purlin; resting said tube upon the lower flange of said adjacent purlin; and, lowering the insulation onto said tube.

* * * * *